US008506422B2

(12) United States Patent
Monteiro

(10) Patent No.: US 8,506,422 B2
(45) Date of Patent: Aug. 13, 2013

(54) GOLF PUTTER WITH A CIRCULAR, PLAIN, VERTICAL, SMOOTH AND GRADED HEAD

(75) Inventor: José Manuel Silvestre Monteiro, Cascais (PT)

(73) Assignee: José Manuel Silvestre Monteiro, Cascais (PT)

( * ) Notice: Subject to any disclaimer, the term of this patent is extended or adjusted under 35 U.S.C. 154(b) by 277 days.

(21) Appl. No.: 12/595,446

(22) PCT Filed: Jun. 6, 2007

(86) PCT No.: PCT/PT2007/000025

§ 371 (c)(1),
(2), (4) Date: Oct. 9, 2009

(87) PCT Pub. No.: WO2008/143538

PCT Pub. Date: Nov. 27, 2008

(65) Prior Publication Data

US 2010/0075775 A1 Mar. 25, 2010

(30) Foreign Application Priority Data

May 20, 2007 (PT) ..... 10226 M

(51) Int. Cl.
*A63B 53/04* (2006.01)

(52) U.S. Cl.
USPC ..... 473/340

(58) Field of Classification Search
USPC ..... 473/251, 252, 324–350
See application file for complete search history.

(56) References Cited

U.S. PATENT DOCUMENTS

| | | | | | |
|---|---|---|---|---|---|
| 1,631,504 | A | * | 6/1927 | Redman | 473/313 |
| 2,820,638 | A | * | 1/1958 | Morrison | 473/252 |
| 2,954,231 | A | * | 9/1960 | MacIntyre | 473/251 |
| D205,041 | S | * | 6/1966 | Capps | D21/759 |
| 3,954,265 | A | * | 5/1976 | Taylor | 473/252 |
| D240,751 | S | * | 7/1976 | Taylor | D21/734 |
| 4,073,492 | A | * | 2/1978 | Taylor | 473/409 |
| 4,174,839 | A | * | 11/1979 | Marrs | 473/252 |
| 4,265,451 | A | * | 5/1981 | Bernhardt | 473/313 |

(Continued)

FOREIGN PATENT DOCUMENTS

| | | | |
|---|---|---|---|
| JP | 04022373 | A * | 1/1992 |
| JP | 08229170 | A * | 9/1996 |

(Continued)

OTHER PUBLICATIONS

International Search Report for PCT/PT2007/000025 dated Aug. 21, 2007.

*Primary Examiner* — Alvin Hunter
(74) *Attorney, Agent, or Firm* — Kenealy Vaidya LLP

(57) ABSTRACT

This utility model refers to a golf putter that, contrary to a head with a straight and plain face, has a circular, plain, vertical, smooth and graded face.

With a common putter, a player aligns himself with the line of putt. However, with the use of a circular and plain face, a player aligns himself with the hole. The putter's head indicates the line of putt. This being, a player's stroke is always perpendicular to the ball's axis and in direction of the line of putt's angle. With a circular and plain face, the head is positioned and, thus, the angle is no longer 0°. Rather, it takes on a specific degree reflecting the chosen line of putt. The angle only changes through repositioning the putter. This utility model is applicable in the manufacturing of Putters.

7 Claims, 5 Drawing Sheets

U.S. PATENT DOCUMENTS

| | | | | | |
|---|---|---|---|---|---|
| 4,290,606 | A | | 9/1981 | Maxwell | |
| 4,659,083 | A | * | 4/1987 | Szczepanski | 473/252 |
| 4,702,477 | A | * | 10/1987 | Solomon | 473/313 |
| 4,795,157 | A | * | 1/1989 | Bencriscutto | 473/251 |
| 4,921,253 | A | * | 5/1990 | Tesori | 473/341 |
| 5,456,464 | A | * | 10/1995 | Davenport et al. | 473/251 |
| 5,467,987 | A | * | 11/1995 | Perkins et al. | 473/340 |
| 5,533,728 | A | * | 7/1996 | Pehoski et al. | 473/252 |
| 5,601,499 | A | * | 2/1997 | Segaline | 473/313 |
| 5,615,884 | A | * | 4/1997 | Modglin | 473/238 |
| 5,759,114 | A | * | 6/1998 | Bluto et al. | 473/340 |
| 5,846,140 | A | * | 12/1998 | Hoburg | 473/240 |
| 5,863,262 | A | * | 1/1999 | Donofrio | 473/330 |
| 5,954,593 | A | * | 9/1999 | Benoit et al. | 473/240 |
| 6,062,986 | A | * | 5/2000 | Kaise | 473/242 |
| 6,099,413 | A | * | 8/2000 | Naylor | 473/226 |
| 6,155,933 | A | * | 12/2000 | Schmitt | 473/330 |
| 6,183,379 | B1 | | 2/2001 | Kim et al. | |
| 6,342,018 | B1 | * | 1/2002 | Mason | 473/252 |
| 6,379,258 | B1 | * | 4/2002 | To | 473/242 |
| 6,464,598 | B1 | * | 10/2002 | Miller | 473/314 |
| 6,558,268 | B2 | * | 5/2003 | Tindale | 473/244 |
| 6,579,194 | B1 | * | 6/2003 | Curry | 473/328 |
| 6,739,980 | B2 | * | 5/2004 | Scott et al. | 473/200 |
| 7,077,757 | B1 | * | 7/2006 | Payne et al. | 473/238 |
| RE39,472 | E | * | 1/2007 | Ahn et al. | 473/249 |
| 7,156,753 | B2 | * | 1/2007 | Casner et al. | 473/340 |
| 7,172,513 | B1 | * | 2/2007 | Rinker | 473/219 |
| 2002/0025858 | A1 | * | 2/2002 | Sosin | 473/340 |
| 2002/0151374 | A1 | | 10/2002 | Imamura | |
| 2003/0040374 | A1 | | 2/2003 | Fowler et al. | |
| 2004/0005935 | A1 | * | 1/2004 | Casner et al. | 473/340 |
| 2006/0014591 | A1 | | 1/2006 | Engdahl | |
| 2006/0287130 | A1 | * | 12/2006 | Allen | 473/340 |

FOREIGN PATENT DOCUMENTS

| | | | | |
|---|---|---|---|---|
| JP | 09024126 | A | * | 1/1997 |
| JP | 11057087 | A | * | 3/1999 |
| JP | 2000037483 | A | * | 2/2000 |
| JP | 2002306648 | A | * | 10/2002 |
| JP | 2003010374 | A | * | 1/2003 |
| JP | 2008012200 | A | * | 1/2008 |
| JP | 2009045338 | A | * | 3/2009 |

* cited by examiner

GOLF PUTTER WITH A CIRCULAR, PLAIN, VERTICAL, SMOOTH AND GRADED HEAD

This application is a U.S. national phase filing under 35 U.S.C. §371 of PCT Application No. PCT/PT2007/000025, filed Jun. 6, 2007, and claims priority thereto under 35 U.S.C. §119 to Portuguese patent application no. 10226 M, filed May 20, 2007, the entireties of both of which are incorporated by reference herein.

This utility model is for a putter with a Plain, Circular, Vertical and Smooth face. It is in the configuration of this face where the technique of contact with the ball lies. Furthermore, the transition of the sole to the face (slope) is not susceptible to friction when sliding across the green.

With a Plain, Straight, Vertical and Smooth-faced putter, the face's configuration calls for contacting the ball in the same manner at all times; however, the edge/corner of the sole with the face is more susceptible to friction when moving across the green.

Due to the nature of a ball's surface, contact with a putt's face is not always limited to a single point. It can take on different forms, regardless of the face's geometrical form. While a straight face stretches out horizontally, a curvilinear face stretches out vertically. This does not cause any deviation in trajectory, unlike the case with a straight-faced putt. The ball's movement is the result of a strike perpendicular to the rolling axis, which is more directional should the point of contact with the putt be less.

A circular configuration corrects the "openness" or closure of the putt when swinging since the strike is always done in the direction of the face's radius. Its deviation from the line decreases accordingly. This being, it influences the ball's course, closing in on the line of putt previously chosen.

It should be duly noted that, at any point on the circular putter, does its impact on the ball produce any effects on the ball's rotation, whether at the beginning of the stroke, during the ball's trajectory or even at the end of its course. The movement is only that of rolling.

The scale on the Crown (1) shown on the Face (2) is symmetrical in regards to the putt's axis, having an interval of 0°-20° according to the radius of the putt's face. For the same angle, the amplitude is proportional to the variation of the radius. Therefore, the graded scale is reduced to 0° (zero degrees) when the face becomes straight.

With this putt, the player is always aligned with the direction of the hole and the line of putt is defined by the position of the putt's face perpendicular to the player's plane. Here, the ball's axis coincides with the graduation of the putt's crown indicating the desired line.

The Circular, Plain, Vertical, Smooth and Graded-faced Golf Putter can always be used as a common straight, plain, vertical, smooth-faced putter.

The fundamental difference between a Plain, Straight-Faced Putter and a Plain Circular Putter is as follows:

a) With a Plain Straight-Faced Putter, the line of putt is defined by the player who adjusts his alignment.

b) With a Plain Circular-Faced Putter, the player is always in alignment with the hole, despite the line of putt being defined by the position of the putter's head perpendicular to the player's plane.

The philosophy is:

1—If the hole is on a leveled or inclined plain and the line of putt is inline with the hole, the player's alignment and the putter's axis coincide with that line. The stroke is carried out with a swinging movement, using the necessary force, in the same manner as with a normal putter.

2—If the hole is positioned on the green so that its line of putt lies to its right or to its left, the player's alignment and the putter's axis are inline with the hole. The line of putt is corrected by the putter's circular head, solely by moving the axis in the direction perpendicular to the player's alignment. It is the positioning of the putter to either side of the ball's axis that allows one to find the angle indicating the line of putt. Afterwards, all that is needed is to swing and strike the ball as if using a normal putter.

When the inclination is to the right of the hole, the line of putt is corrected by moving the putter's axis perpendicularly to the player's plane and in its direction.

If the inclination is to the left of the hole, the line of putt is corrected by moving the putter's axis perpendicularly to the player's plane and in the opposite direction.

When comparing a traditional putt to a circular-faced putt under the same conditions (moisture content of the green, synthetic green, etc.) the following is noted:

With a circular-faced putter, a Slope (7) of 45° at the transition point between the Sole (3) and the Face (2) facilitates the sliding of the putt across the green. Meanwhile, with a straight-faced putt, the edge/corner of the sole and the face causes more friction when doing the same.

On the overgreen, the space between the rough and the green, this putter is more efficient than a traditional putter since its slope is of utmost importance for sliding on this surface.

This utility model is explained in further detail with the aid of annexed drawings, among which:

Figure 3:
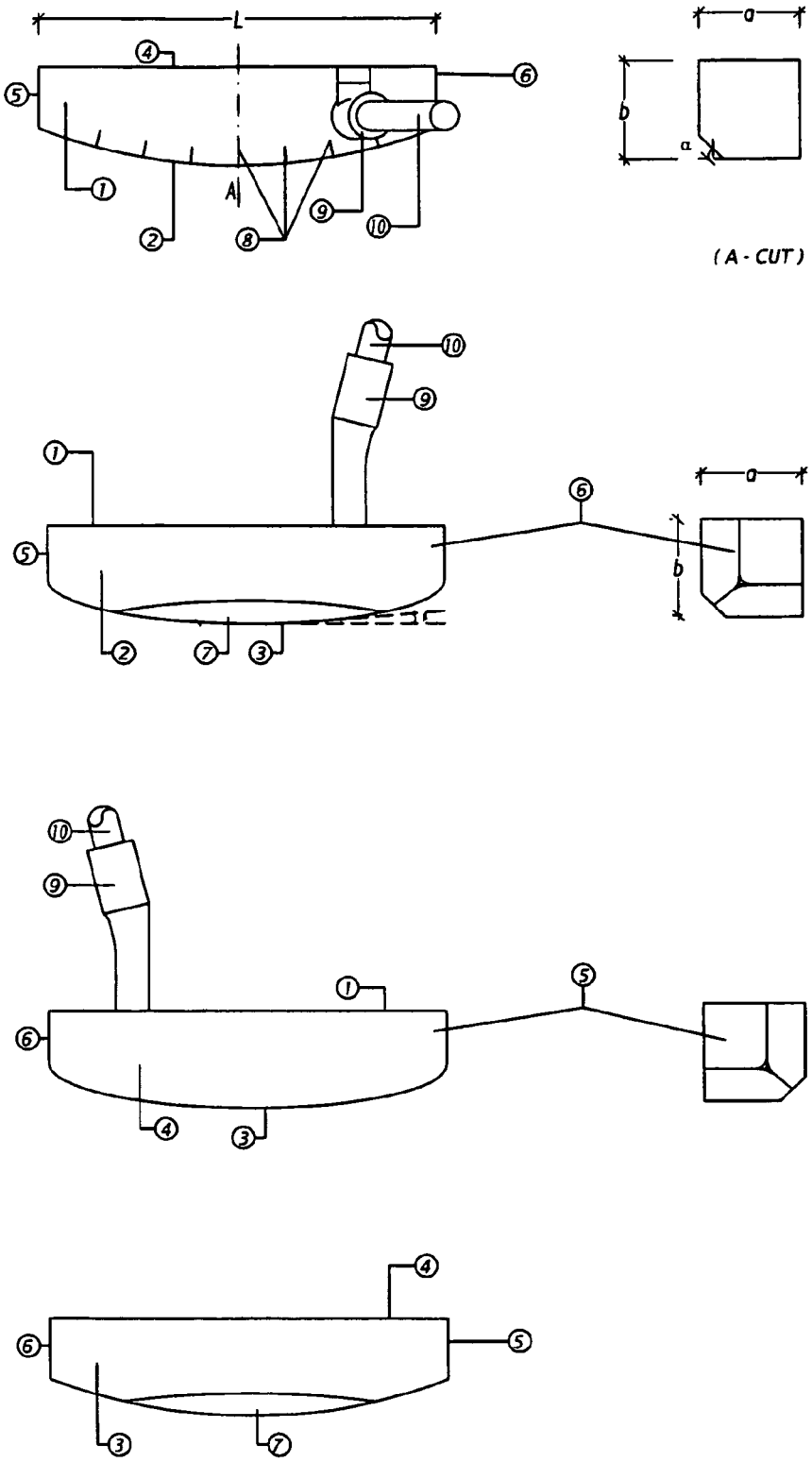
FIG. 3 is the same as above but the radius of the face has changed as has the respective scale from 0°-20° to 0°-15°. The dimensions presented in this figure are different from those in the Mold because this is considered the Base Model of this utility model (the Base Model will be described later on)
Figure 4:
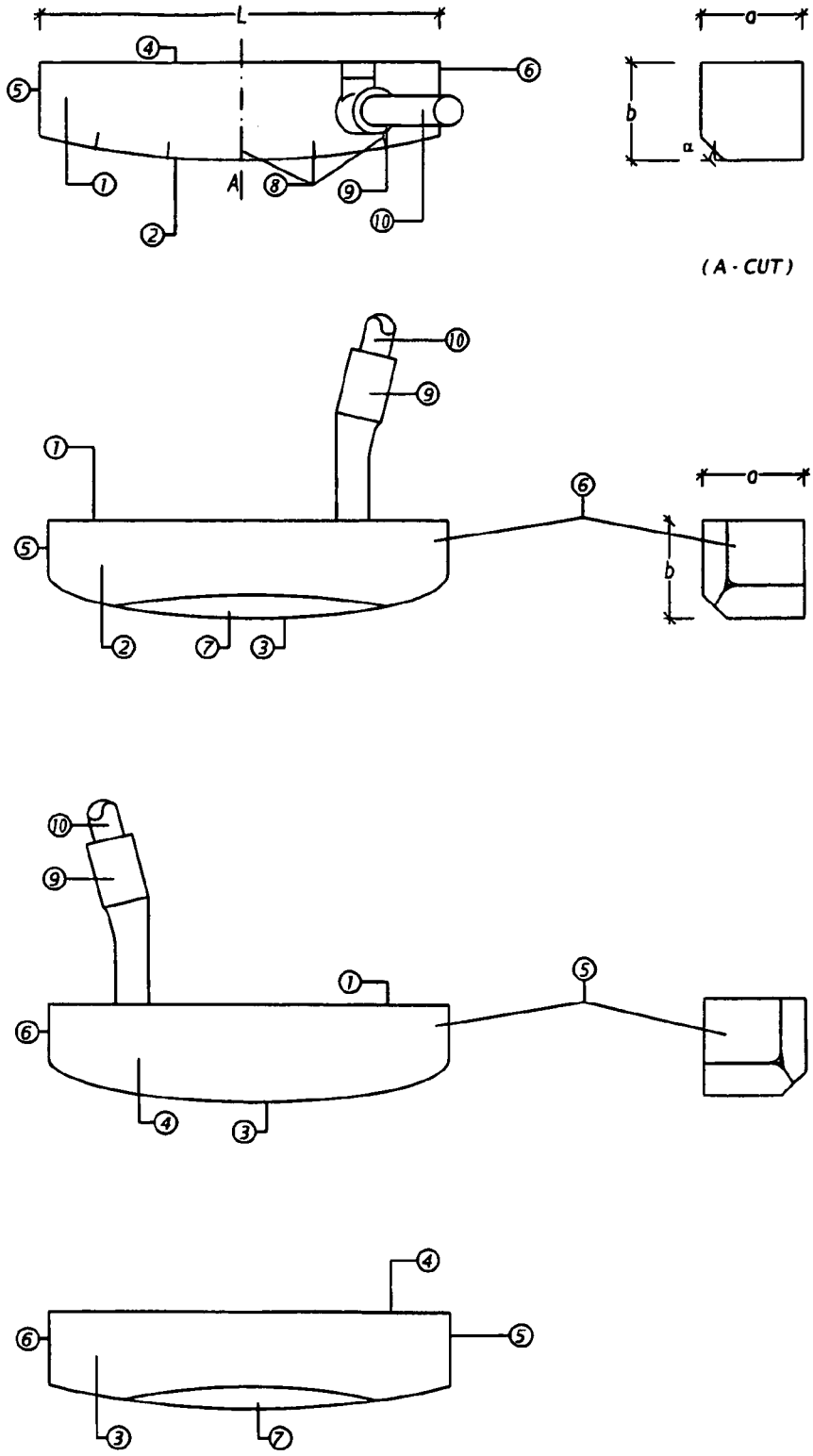
Figure 5:
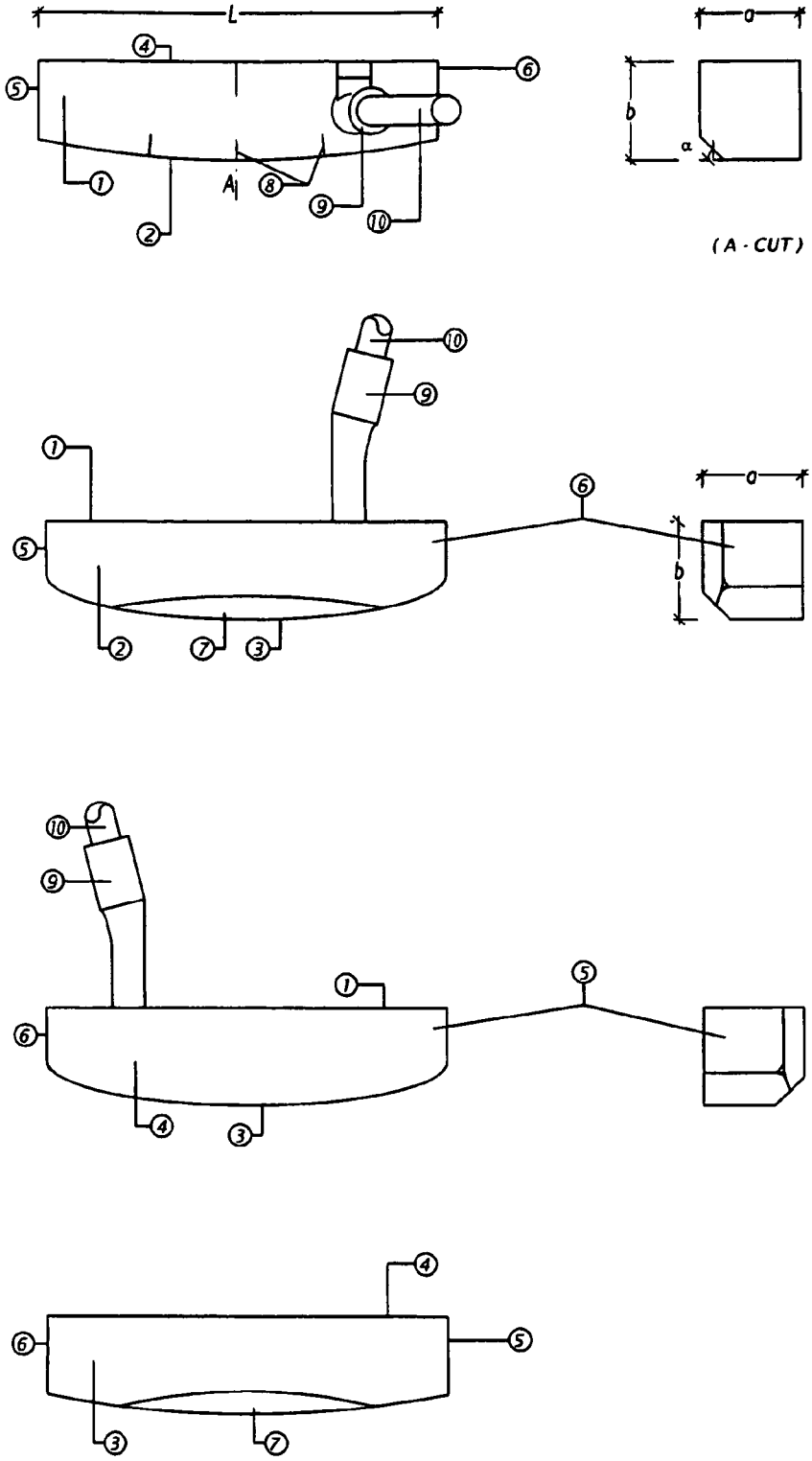

In FIG. 4, all the characteristics of the Base Model (FIG. 3) are maintained, having only changed the face's radius and the respective scale from 0°-15° to 0°-10°;

In FIG. 5, all the characteristics of the Base Model (FIG. 3) are maintained, having only changed the face's radius and the respective scale from 0°-15° to 0°-5°;

Initially, a face radius of 7×ϕ was considered as the starting point for the scale 0°-20°. This is conditioned by the variation of radiuses within the face's limits, so as that the impact on the ball is in the intended direction.

Figure 1:
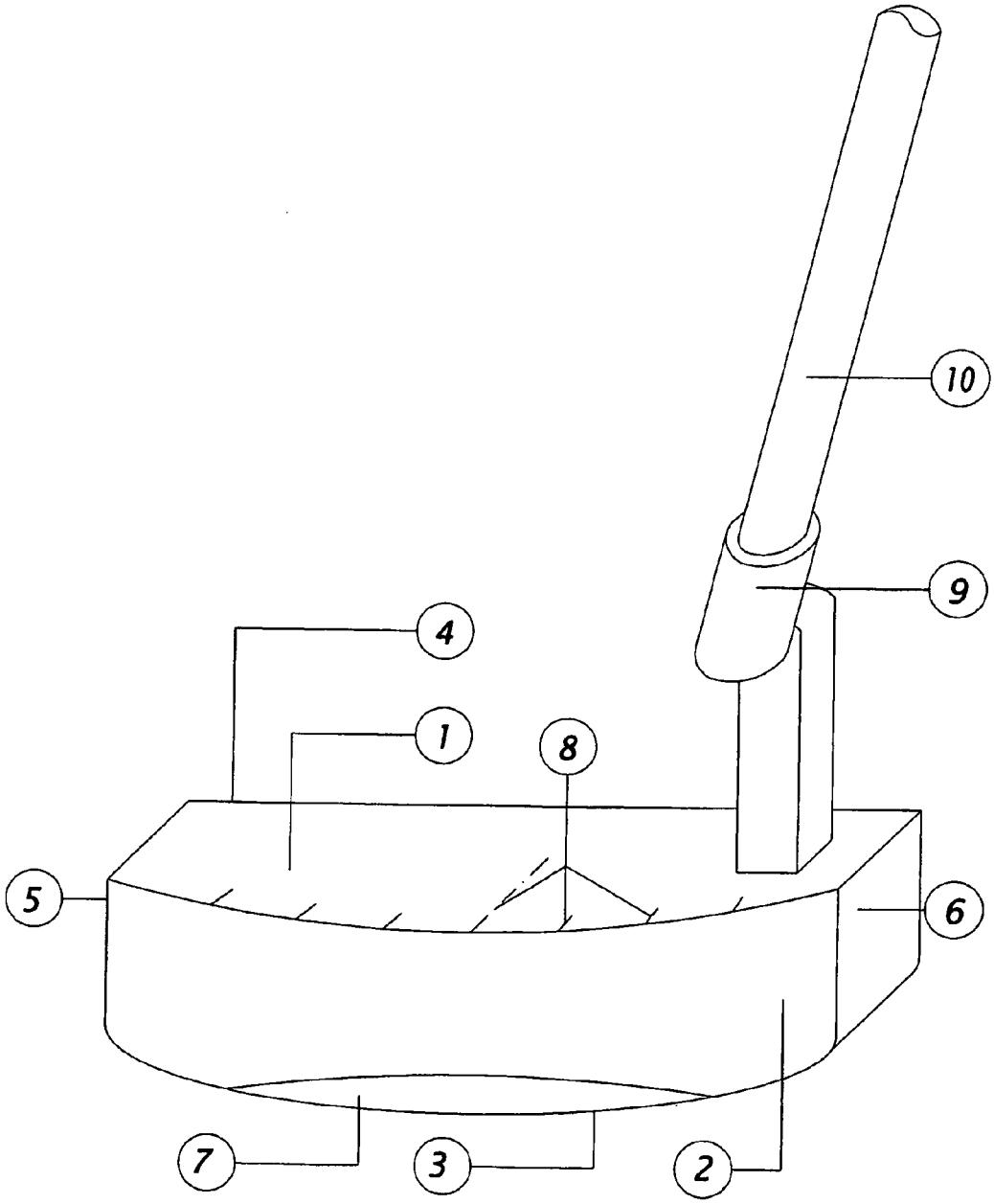
FIG. 1 is a side view of the utility model for the Plain, Circular, Vertical, Smooth and Graded Putter.
Figure 2:
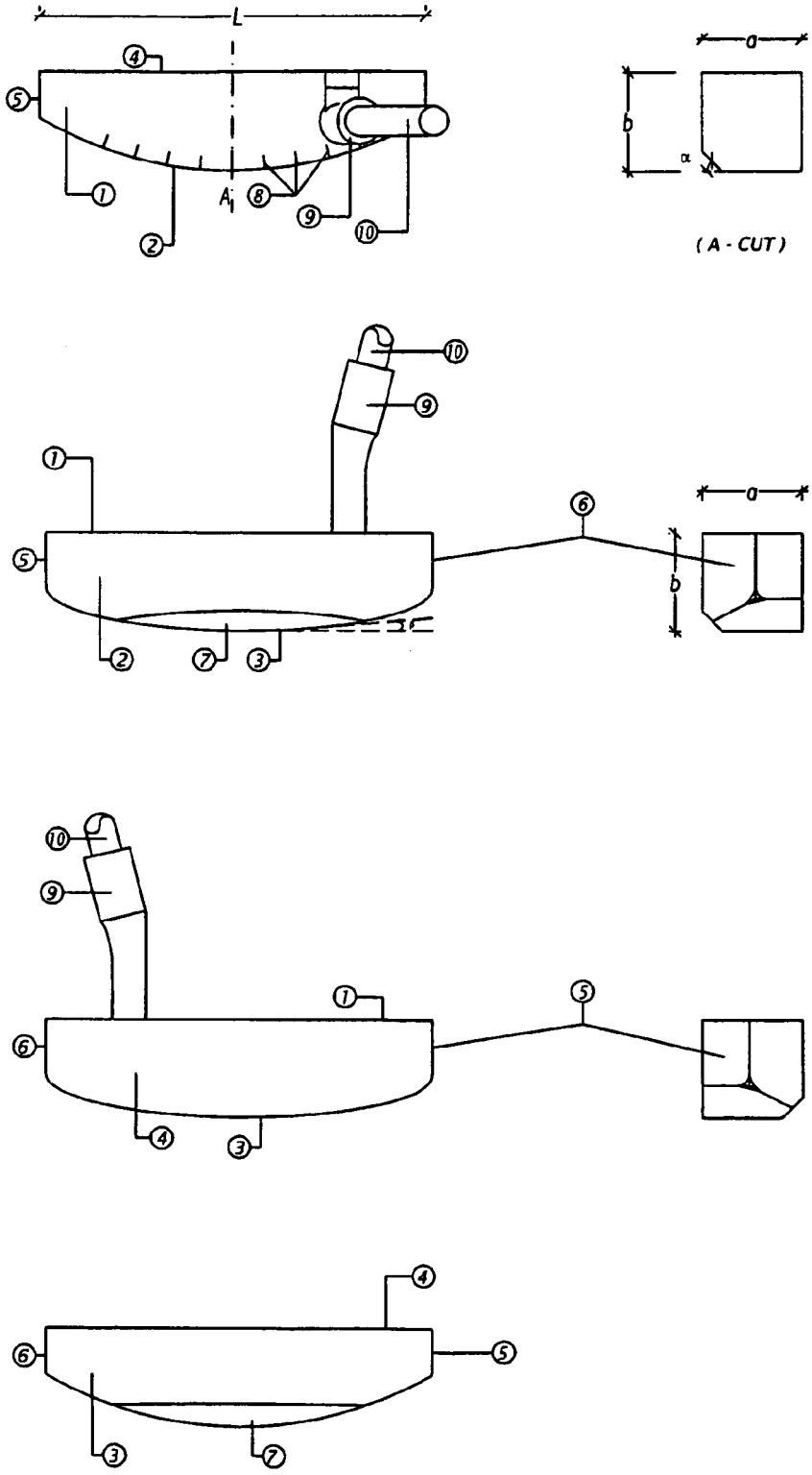
FIG. 2 is the Mold for this utility model depicting the Crown (1) with a graded Scale (8) between 0° to 20°, Face (2), Back (4), Sole (3), Toe (5), Heel (6) and Slope (7) (FIG. A), Neck/Socket (9) and the Shaft (10).

As can be seen in FIG. 2, the degree scale for the Plain Circular Faced-Putter varies. In this drawing, its limits are 0°-20° symmetrically to the putter's axis. In FIGS. 3, 4 and 5, the degree scale is reduced until reaching the maximum scale of 0°-5°, in accordance with the increase of the face's radius.

This being, the putter's dimensions (FIG. 2: Mold—Scale 1/200), which were calculated using the proportional value of (phi) ϕ=1.618 converted into millimeters (mm), are:

L=7×ϕ (113.26 mm) (length)

a=2×ϕ (32.36 mm) (width)

b=2×ϕ (32.36 mm) (height)

R=7×ϕ (113.26 mm) (Face)

R=14×ϕ (226.52 mm) (Elliptical Sole)

R=2.7×ϕ (43.68 mm) (joining of the sole (3) with the toe (5) and heel (6))

α=45° Slope (transition of the sole (3) to the circular face (2))

β5° Angle of the Sole (3)

In this Figure, the Putter description consists of the following:

CROWN (1)—Plain, Circular and Graded) (0°-20°)

FACE (2)—Plain, Circular, Vertical and Smooth

SOLE (3)—Elliptical

BACK (4)—Plain and Vertical

TOE (5)—Plain and Vertical

HEEL (6)—Plain and Vertical

SLOPE (7)—Plain) (45°)

SCALE (8)—0°-20°)

NECK/SOCKET (9)—Circular Ø14 mm and rectangular 10×8 mm, 20 mm from the heel SHAFT (10)—Section variable to 14° vertically Based on the Mold (FIG. 2) and in keeping with the parameters established by the rules for the Design of Cubs[1] that do not allow such proportions, a Base Model (FIG. 3) was created with the following dimensions:

[1] Appendix II—Design of Clubs; Number 4—Clubhead; Article b—Dimensions and Size; Page 160

L=120.00 mm (length)

a=30.00 mm (width)

b=30.00 mm (height)

For any option, the only variables are: the Face's Radius (R), the concordant radius (r), and the degree scale.

Three Examples are provided to depict how the face's radius influences the variations in the degree scale.

In FIG. 3, the Radius (R)=165.00 mm permits a symmetrical scale between 0°-15°.

In FIG. 4, the Radius (R)=250.00 mm permits a symmetrical scale between 0°-10°.

In FIG. 5, the Radius (R)=300.00 mm permits a symmetrical scale between 0°-5°.

Within the limits between the Base Model (FIG. 2) and the Plain Straight-Faced Putter, various face radiuses are possible.

It can therefore be concluded that the variation of the face's radius is proportional to the amplitude. It increases the correction of the trajectory as it lessens. A radius of 300.00 mm is close to the maximum limit for the transition of the Plain Circular-Faced Putter to the Plain Straight-Faced Putter. Therefore, the angles are maintained but the projection in the face's perimeters (amplitude) is greater as the radius increases. As the Radius of the Putt's Face decreases, the degree of precision increases.

All that is described here was tested and proven through the use of a prototype that was constructed to be used with different face radiuses.

The possibilities for industrial application are vast since manufacturing can be done for the most varied face and sole radiuses. There is also the possibility of constructing a model in which the face can be substituted according to the desired radius and degree of difficulty/challenge.

The invention claimed is:

1. A golf putter comprising:

a crown, a ball-addressing face, a sole, a back, a toe, a heel, a neck/socket, and a shaft, wherein the crown includes a planar crown surface, and depicts a radial scale, when viewed from above, wherein the ball-addressing face includes two portions, a first portion that extends substantially normal to the planar crown surface and is uniformly curved in a convex manner extending away from a center of the crown surface and is configured to contact a ball during play, and a second portion including a flat portion that slopes at an angle of approximately 45 degrees from the first portion towards the sole, and wherein the sole includes a surface that is uniformly curved from the heel to the toe in a convex manner extending away from and opposed to the crown surface, and wherein the neck/socket is located closer to the heel than the toe.

2. The golf putter according to claim 1, wherein the first portion that extends substantially normal to the planar crown surface and is curved in a convex manner extending away from the crown surface of the ball-addressing face has a radius of substantially 113 mm to substantially 300 mm.

3. The golf putter according to claim 1, wherein the sole surface that is curved in a convex manner extending away from the crown surface has a radius of substantially 226 mm to substantially 300 mm.

4. The golf putter according to claim 1, wherein the putter includes a single piece putter head.

5. The golf putter according to claim 1, wherein the putter is adapted for a right-handed golfer.

6. The golf putter according to claim 1, wherein the putter is adapted for a left-handed golfer.

7. The golf putter according to claim 1, wherein the sole surface that is curved in a convex manner is a surface that is substantially normal to the first portion of the ball-addressing face.

* * * * *

UNITED STATES PATENT AND TRADEMARK OFFICE

CERTIFICATE OF CORRECTION

PATENT NO. : 8,506,422 B2
APPLICATION NO. : 12/595446
DATED : August 13, 2013
INVENTOR(S) : José Manuel Silvestre Monteiro It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 405 days.

Signed and Sealed this
Fifteenth Day of September, 2015

Michelle K. Lee

Michelle K. Lee
*Director of the United States Patent and Trademark Office*